US008488827B2

(12) United States Patent
Akino

(10) Patent No.: US 8,488,827 B2
(45) Date of Patent: Jul. 16, 2013

(54) CONDENSER MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 168 days.

(21) Appl. No.: 13/096,474

(22) Filed: Apr. 28, 2011

(65) Prior Publication Data

US 2011/0266087 A1 Nov. 3, 2011

(30) Foreign Application Priority Data

Apr. 30, 2010 (JP) ..... 2010-105032

(51) Int. Cl.
*H04R 19/04* (2006.01)

(52) U.S. Cl.
USPC ..... 381/355; 381/174; 381/189; 439/101

(58) Field of Classification Search
USPC ..... 381/150, 369, 355, 174, 189; 181/158; 439/101
See application file for complete search history.

(56) References Cited

U.S. PATENT DOCUMENTS

2006/0046538 A1* 3/2006 Akino ..... 439/101
2006/0251274 A1* 11/2006 Akino ..... 381/111
2010/0255720 A1* 10/2010 Radzik et al. ..... 439/578

FOREIGN PATENT DOCUMENTS

JP 2005-311752 4/2005
JP 2005-094575 7/2005

* cited by examiner

*Primary Examiner* — Curtis Kuntz
*Assistant Examiner* — Joshua Kaufman
(74) *Attorney, Agent, or Firm* — Whitham Curtis Christofferson & Cook, PC

(57) ABSTRACT

A condenser microphone includes a cylindrical microphone case having a condenser microphone unit therein; a microphone connector having an insulating base, one ground pin and two signal pins are embedded in the microphone connector; and a cylindrical connector sleeve fitted in the microphone case and accommodating the microphone connector therein, in which the connector sleeve has a concave-convex part on the outer peripheral surface thereof, the concave-convex part is in contact with the inner peripheral surface of the microphone case at a plurality of points after the connector sleeve is fixed into the end of the microphone case by fixing means, and thereby the connector sleeve is electrically conducted with the microphone case.

9 Claims, 8 Drawing Sheets

CONDENSER MICROPHONE

BACKGROUND OF THE INVENTION

1. Field of the Invention

The present invention relates to a condenser microphone capable of blocking entrance of electromagnetic waves to a microphone case and noise generation.

2. Description of the Related Art

An acoustic signal converted in a condenser microphone unit is output from a condenser microphone to the exterior thereof through a balanced shielded cable. The condenser microphone is detachably connected with the balanced shielded cable via a three-pin microphone connector. The connector is generally specified in EIAJ RC-5236 "Latch Lock Type Round Connector for Audio Equipment" (See "EIAJ RC-5236 Latch Lock Type Round Connector for Audio Equipment according to the Standards of the Japan Electrical Manufacturers' Association").

FIG. 6 illustrates an example condenser microphone including such a specified connector (hereinafter referred to as "microphone connector"). Technical ideas of the present invention can be applied to the condenser microphone shown in FIG. 6.

An example conventional condenser microphone will be described with reference to FIG. 6. As shown in FIG. 6, a microphone unit 2 is included in an inner front end of a cylindrical microphone case 1 (the lower end in FIG. 6). The microphone unit 2 outputs electrical acoustic signals in response to sound waves.

A circuit board 3 is built in the microphone case 1. The acoustic signals are impedance-converted by an impedance converter that is included in the circuit board 3. Furthermore, signal processing such as amplification processing is performed. The specified microphone connector 4 is included in the rear end of the microphone case 1 (the upper end in FIG. 6).

The microphone connector 4 is a male connector which includes a pin insert 5 that is housed in a cylindrical connector sleeve 6 and is fixed to the connector sleeve 6 with a screw 9.

The pin insert 5 penetrates a base 7 that is composed of an insulating material, such as thermoplastic resin in a thickness direction of the base 7. The pin insert 5 includes three connector pins 11, 12 and 13 which are integrally mounted to the base 7. Since the connector pins 11 and 12 are aligned in a depth direction, they are depicted as one connector pin in FIG. 6.

The base 7 has a cylindrical external shape and is fitted to the connector sleeve 6 along the inner periphery of the connector sleeve 6. A threaded hole is formed in the base 7. The screw 9 is screwed into the threaded hole from the outer peripheral surface of the base 7 towards the center. The screw 9 is radially projected from the outer peripheral surface of the base 7. A shoulder of screw 9 is in contact with the inner peripheral surface of the connector sleeve 6. The outer peripheral surface of the base 7 at the opposite side of the screw 9 presses the inner peripheral surface of the connector sleeve 6 by screwing the screw 9 into the threaded hole. Thus, the pin insert 5 is fixed in the connector sleeve 6.

The connector sleeve 6 is fixed at a predetermined position in the microphone case 1 with a screw 10 screwed from the outer peripheral surface of the microphone case 1. Details about the fixing mode of the connector sleeve 6 to the microphone case 1 will be described below.

Since an electronic circuit including a semiconductor device is incorporated in the circuit board 3, penetration of electromagnetic waves into the microphone case 1 causes mixing of a noise into acoustic signals output from the microphone unit 2. In order to prevent such penetration of electromagnetic waves into the microphone case 1, an electromagnetic shield is effectively applied to the microphone unit 2. At the rear end of the condenser microphone (adjacent to the microphone connector) has an opening through which the electromagnetic waves disadvantageously penetrate. Accordingly, the electromagnetic shield is effectively applied by putting a shielding material on the rear end of the microphone.

As shown in FIG. 7, however, the condenser microphone is assembled by inserting a unit (FIG. 7A) that is composed of the circuit board 3 and the microphone connector 4 housed in the connector sleeve 6 into the microphone case 1 (FIG. 7B) through the opening (upper end of the microphone case 1), and fixing this unit to the microphone case 1 with the screw 10 screwed from the outer peripheral surface of the microphone case 1. Accordingly, the opening of the microphone case 1 cannot be completely sealed.

Furthermore, in order to insert the unit including the microphone connector 4 and the circuit board 3 into the microphone case 1, the outer periphery of the connector sleeve 6 needs to be slightly smaller in diameter than the inner periphery of the microphone case 1.

Accordingly, a gap between the connector sleeve 6 and the microphone case 1 is inevitably formed.

Next, the relationship between the inner peripheral surface of the microphone case 1 and the outer peripheral surface of the connector sleeve 6 will be described below with reference to FIG. 8, which is an enlarged cross sectional view of B-B'line shown in FIG. 6. A gap 8 is the difference between two diameters of the outer periphery of the connector sleeve 6 and the inner periphery of the microphone case 1. As explained above, the dimension of the gap 8 need to have a width enough to insert the connector sleeve 6 into the microphone case 1. The gap 8 shown in FIG. 8 is depicted larger than its real size.

A threaded hole is formed on the outer peripheral surface of the connector sleeve 6. A hole is formed on the outer peripheral surface of microphone case 1 at the position where corresponds to the threaded hole of the connector sleeve 6. The screw 10 is inserted into the hole of the microphone case 1 and screwed into the threaded hole of the connector sleeve 6, thereby fixing the connector sleeve 6 to the predetermined position of the microphone unit 2. Generally, about three screws 10 are used as shown in FIG. 8.

In a part fixed with the screw 10 and a certain area surrounding the fixed part, since the microphone case 1 and connector sleeve 6 attract each other with the screw 10, the outer peripheral surface of the connector sleeve 6 is distorted outward while the inner peripheral surface of the microphone case 1 is distorted inward. Accordingly, the gap 8 at which these distortions are created becomes smaller in width. Moreover, the connector sleeve 6 and microphone case 1 are electrically conducted through the screw 10.

The narrow portion of the gap 8 and the connector sleeve 6 and microphone case 1 electrically conducted through the screw 10 have an electromagnetic shielding effect against electromagnetic waves from the exterior. Since the electromagnetic shielding effect, however, cannot be obtained in the other area, the electromagnetic waves can enter the inside of the microphone case 1 through the gap 8.

In brief, the conventional microphone has an area through which the electromagnetic waves enter the microphone case 1 in the gap 8 between microphone case 1 and the connector sleeve 6. This causes noise in the condenser microphone.

For the purpose of preventing the electromagnetic waves from entering the inside of the condenser microphone, condenser microphones which include a microphone connector in which a shielding case covers one end surface of the base 7 in the pin insert 5, and the connector pin 11 for grounding is soldered to the shielding case to be electrically connected are known (disclosed, for example, in Japanese Unexamined Patent Application Publication Nos. 2005-094575 and 2005-311752).

Each of the condenser microphones disclosed in Japanese Unexamined Patent Application Publication Nos. 2005-094575 and 2005-311752 includes the microphone connector that prevents factors generating noise from entering the inside of the microphone case. These condenser microphones, however, do not have the shielding effect for preventing the electromagnetic waves from entering the microphone case through the gap between the connector sleeve and the microphone case. Accordingly, these condenser microphones do not have enough function of the electromagnetic shield that prevents electromagnetic waves entering from the opening of the microphone case.

SUMMARY OF INVENTION

In view of the circumstances above, an object of the present invention is to provide a condenser microphone including a connector sleeve that prevents electromagnetic waves from entering the inside of a microphone case and prevents noise caused by the electromagnetic waves.

According to an aspect of the present invention a condenser microphone including: a cylindrical microphone case having a condenser microphone unit therein; a microphone connector having an insulating base one ground pin and two signal pins are embedded in the microphone connector; and a cylindrical connector sleeve fitted in the microphone case and accommodating the microphone connector therein. The connector sleeve has the concave-convex part on the outer peripheral surface thereof, the concave-convex part is in contact with the inner peripheral surface of the microphone case at a plurality of points after the connector sleeve is fixed into the end of the microphone case by fixing means, and thereby the connector sleeve is electrically conducted with the microphone case.

According to an aspect of the present invention, a condenser microphone including: a cylindrical microphone case having a condenser microphone unit therein; a microphone connector having an insulating base in which one ground pin and two signal pins are embedded; and a cylindrical connector sleeve fitted in the microphone case and having the microphone connector therein. The microphone case has the concave-convex part on the inner peripheral surface thereof which is in contact with the outer peripheral surface of the connector sleeve at a plurality of points on fixing the connector sleeve into the end of the microphone case by fixing means, and thereby the microphone case is electrically conducted with the connector sleeve.

BRIEF DESCRIPTION OF THE DRAWINGS

FIG. 7 B is a longitudinal cross-sectional view of a microphone case in a typical conventional condenser microphone.

DETAILED DESCRIPTION OF THE PREFERRED EMBODIMENTS

Figure 6:
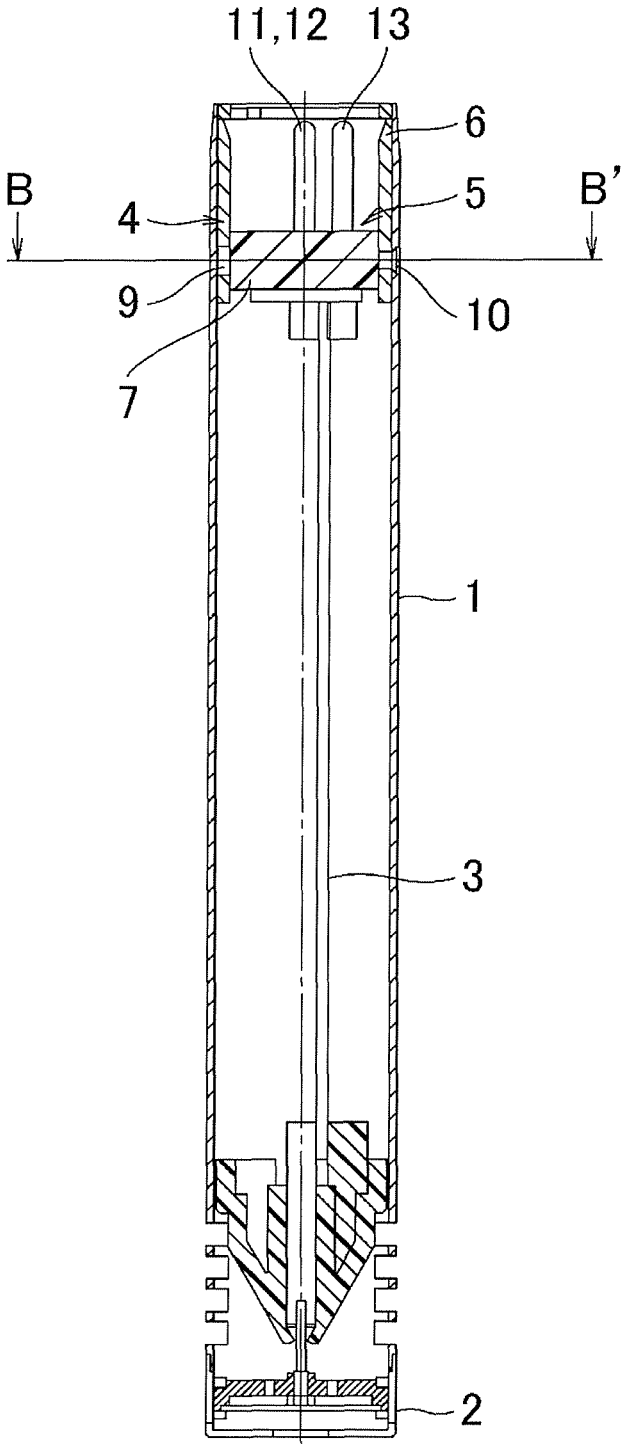
FIG. 6 is a longitudinal cross-sectional view of a typical conventional condenser microphone.
Figure 7A:
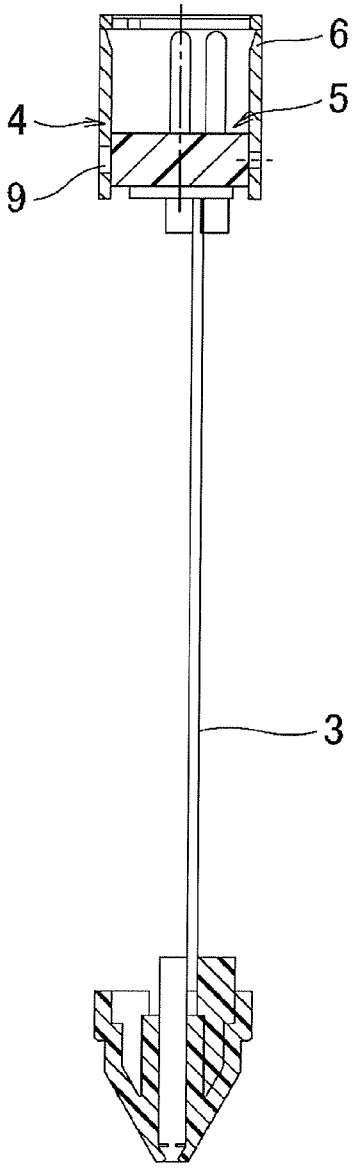
FIG. 7 A is a longitudinal cross-sectional view of a unit including a circuit board and a microphone connector in a typical conventional condenser microphone.
Figure 7B:
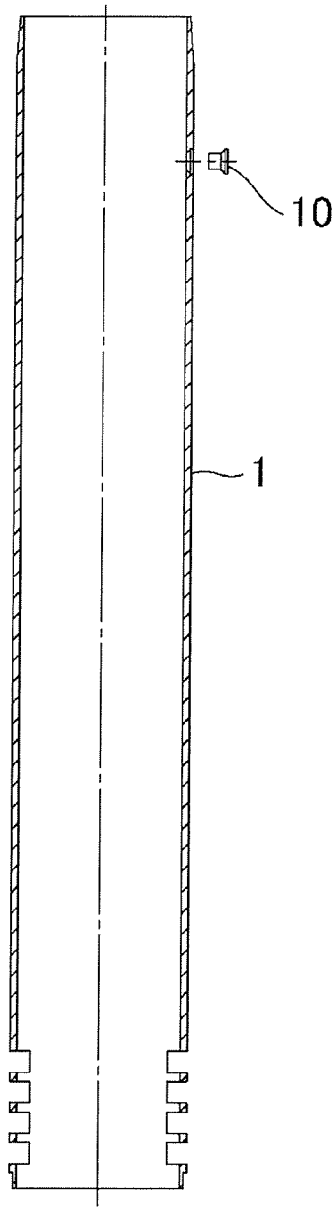
Figure 8:
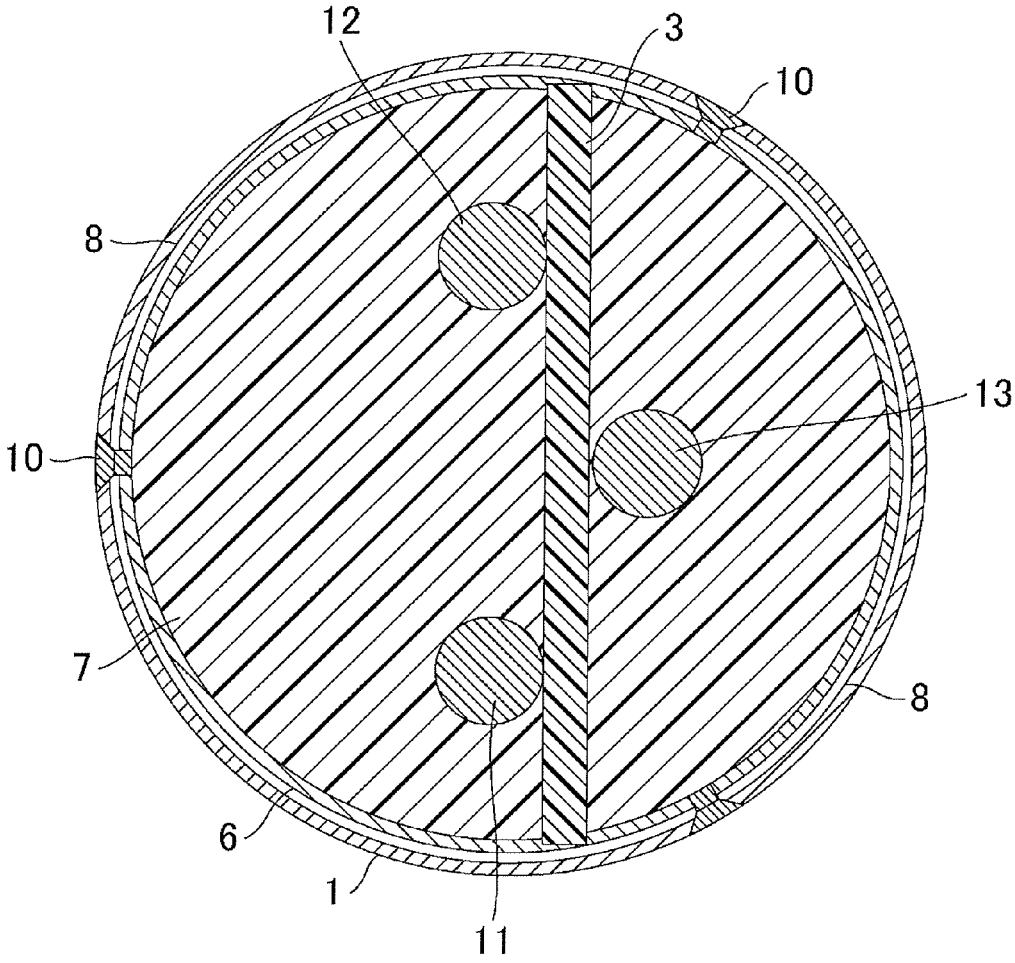
FIG. 8 is a cross sectional view taken from line B-B' in FIG. 6.

A condenser microphone according to an embodiment of the present invention will be described below with reference to the accompanying drawings. In the condenser microphone according to an embodiment of the present invention, elements similar to those in the conventional condenser microphones shown in FIGS. 6 to 8 are given the same reference numerals.

Figure 1:
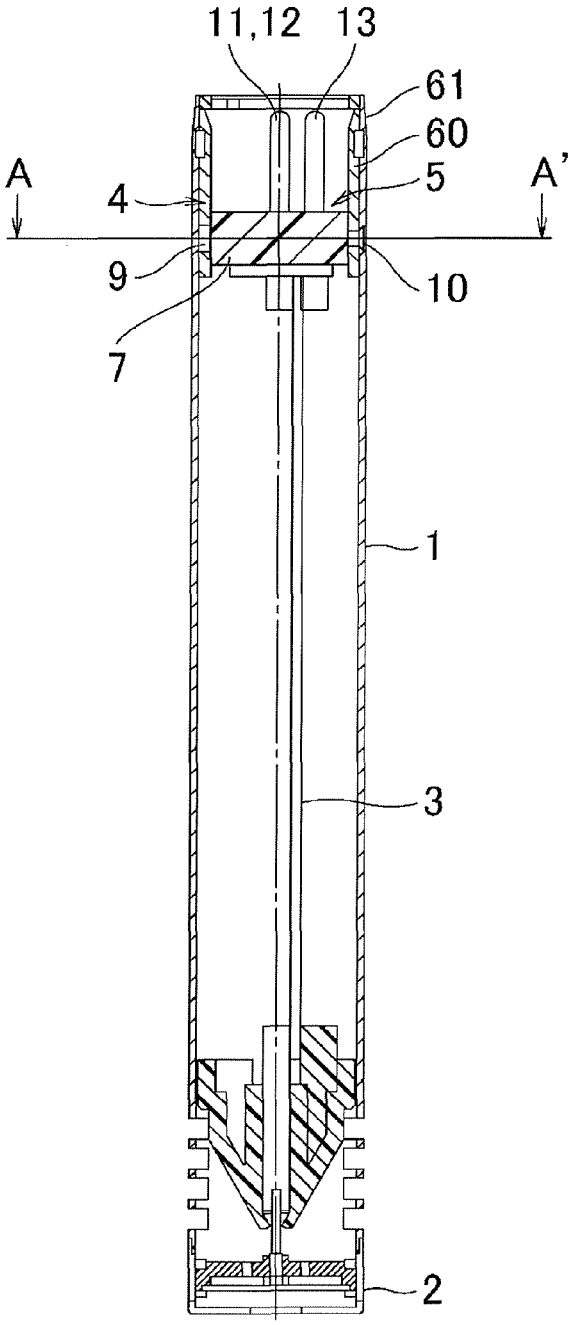
FIG. 1 is a longitudinal cross-sectional view of an exemplary condenser microphone according to an embodiment of the present invention.

As shown in FIG. 1, the condenser microphone according to an embodiment of the present invention includes a cylindrical microphone case 1, a microphone unit 2, and a specified microphone connector 4. The microphone unit 2 and the specified microphone connector 4 are respectively mounted in the front and rear ends of the microphone case 1. The circuit board 3 is interposed between the microphone unit 2 and the microphone connector 4. Sound waves received by the microphone unit 2 are converted into electric acoustic signals. The converted signals are amplified by an impedance converter, to be output from the microphone connector 4.

The output signals are transmitted from the microphone connector 4 to the predetermined external circuit and device via a cable connector and cable both connected to the microphone connector 4.

In the microphone connector 4, a pin insert 5 is disposed inside a cylindrical connector sleeve 60 such that the pin insert 5 is fixed to the connector sleeve 60 with a screw 9.

The pin insert 5 includes a base 7 composed of an insulating material such as thermoplastic resin and three connector pins 11, 12 and 13 which are integrally-mounted in the base 7 so as to be embedded in a thickness direction of the base 7. The base 7 has a cylindrical external shape and is fitted to the connector sleeve 60 along with the inner periphery thereof. A threaded hole is formed in the base 7 into which the screw 9 is screwed from the outer peripheral surface of the base 7 towards the center.

The screw 9 is radially projected from the outer peripheral surface of the base 7. A shoulder of the base 7 is in contact with the inner peripheral surface of the connector sleeve 60. The screw 9 screwed into the threaded hole urges the opposite side of the outer peripheral surface of the base 7 presses the inner peripheral surface of the connector sleeve 60. Thus the pin insert 5 is fixed in the connector sleeve 60.

The connector sleeve 60 is fixed at a predetermined position in the microphone case 1 with a screw 10 screwed in the connector sleeve 60 penetrating the peripheral wall of the microphone case 1. The connector sleeve 60 has a concave-convex part 61 on the outer peripheral surface thereof.

Figure 2:
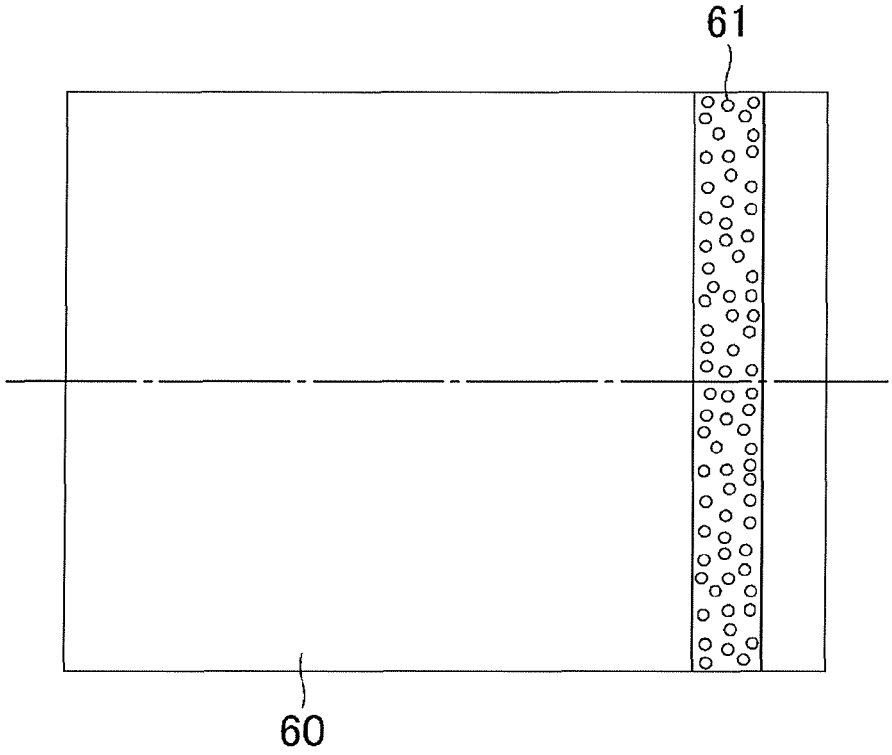
FIG. 2 is a side view of an exemplary connector sleeve as a main part of the condenser microphone according to an embodiment of the present invention.

FIG. 2 illustrates an embodiment of the connector sleeve 60 that is the main feature of the condenser microphone according to the present invention. In FIG. 2, the left side of the connector sleeve 60 is the front end of the condenser microphone (the side on which the microphone unit 2 is mounted). As shown in FIG. 2, the concavo-convex part 61 is formed around the entire periphery and adjacent to the rear end of the connector sleeve 60.

The concavo-convex part 61 is formed by embossing the peripheral surface of the connector sleeve 60, like a patterned surface. For example, the concavo-convex part 61 can be formed by knurling that press a roller against the peripheral surface of the connector sleeve 60 to make convexity on the patterned surface.

The concavo-convex part 61 formed by the above-described processing on the periphery of the connector sleeve 60 has a larger diameter than the other part.

Figure 3:
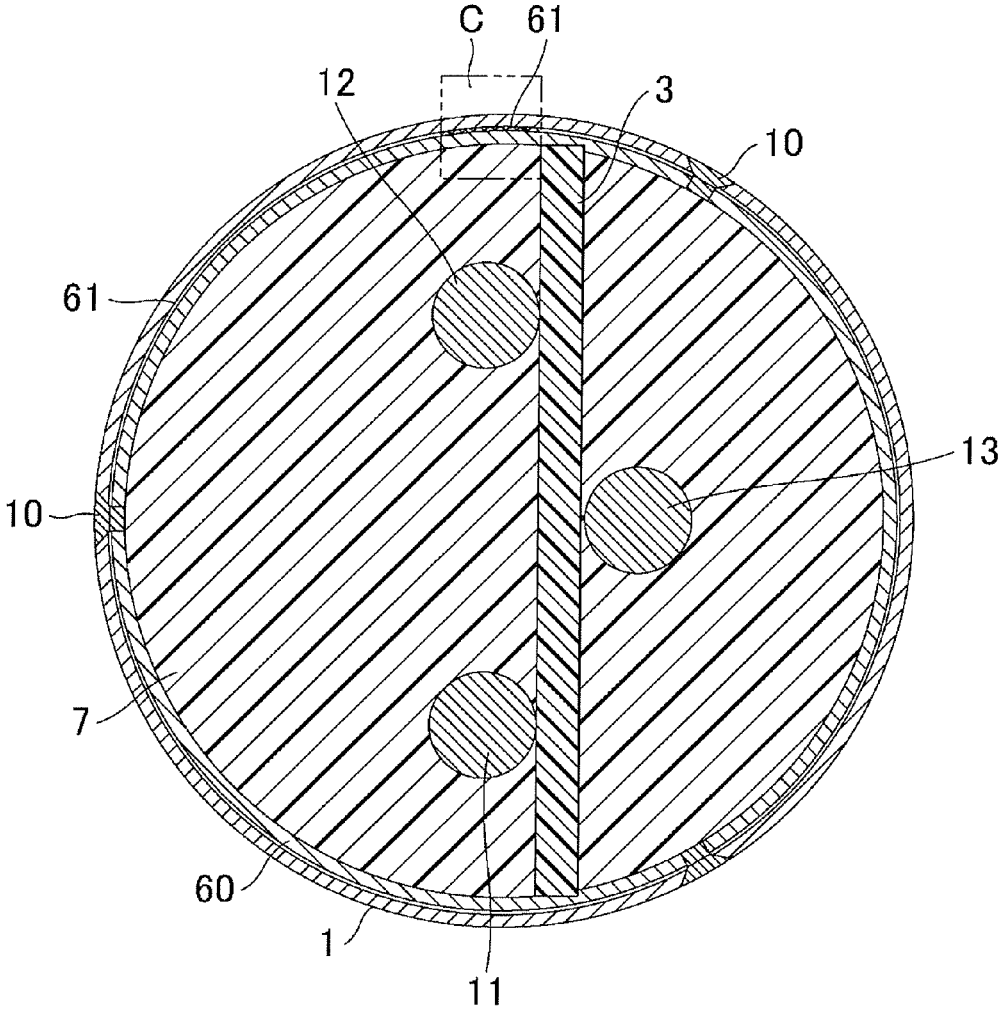
FIG. 3 is a cross sectional view taken from line A-A' in FIG. 1.

A feature of the condenser microphone including this connector sleeve 60 according to an embodiment of the present invention will be described below with reference to FIG. 3. FIG. 3 is an enlarged cross sectional view taken from line A-A' in FIG. 1. As shown in FIG. 2, the concavo-convex part 61 is formed on a part of the peripheral surface of the connector sleeve 60 and the other part thereof has the same diameter as the conventional one. The outer diameter of the part of the connector sleeve 60, other than the concavo-convex part 61, is slightly smaller than the inner diameter of the microphone case 1. Accordingly, a gap for inserting the connector sleeve 60 in the microphone case 1 is formed between the inner peripheral surface of the microphone case 1 and the outer peripheral surface of the connector sleeve 60.

A threaded hole is provided on the outer peripheral surface of the inserted connector sleeve 60. A hole is provided on outer peripheral surface of microphone case 1 at the position corresponding to the threaded hole of connector sleeve 60. The connector sleeve 60 is fixed at the predetermined position of the microphone case 1 by inserting the screw 10 into the hole of the microphone case 1 and screwing into the threaded hole of the connector sleeve 60. In general, about three screws 10 are used to fix the connector sleeve 60 at the center of the microphone case 1 as shown in FIG. 3.

Next, the contact surface of microphone case 1 and the connector sleeve 60 will be explained below with reference to the enlarged view of the area C taken from the chain double-dashed line in FIG. 3.

Figure 4:
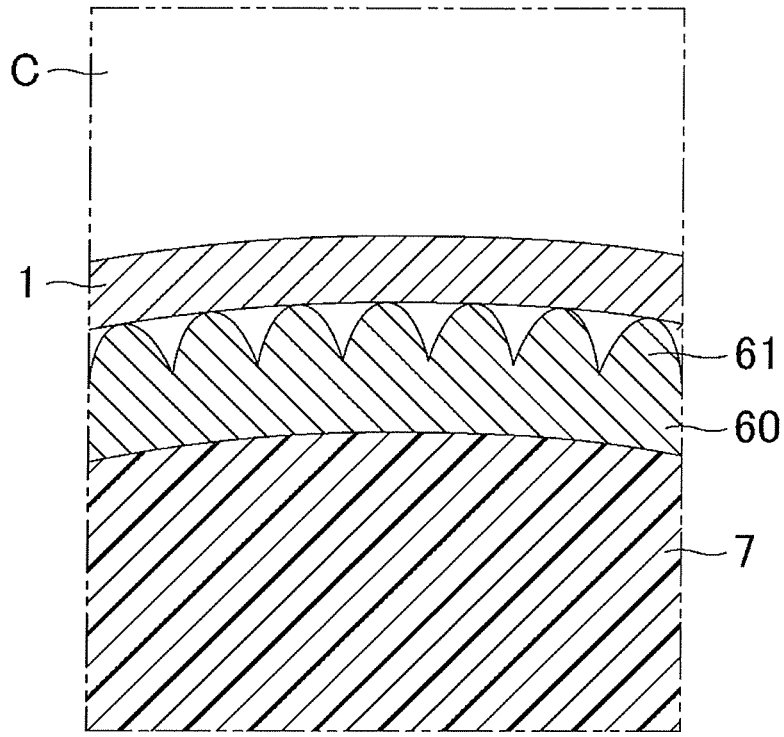
FIG. 4 is a partially enlarged view of an exemplary concave-convex surface according to an embodiment of the present invention.

As shown in FIG. 4, the connector sleeve 60 is in contact with the microphone case 1 via the concavo-convex part 61. The contact portion of the connector sleeve 60 and the microphone case 1 is the convex portion of the concavo-convex part 61 (top of the convex portion). Thus, the connector sleeve 60 is electrically conducted to the microphone case 1 at multiple points.

The conduction of the microphone case 1 and the microphone sleeve 60 at these plural contact portions (points) generates an electromagnetic shielding effect. As described above, the concavo-convex part 61 generates the effective electromagnetic shielding between the microphone case 1 and connector sleeve 60, thereby preventing the electromagnetic waves from entering the inside of the microphone and preventing noise generation.

Since the concavo-convex part 61 is formed at only one part of the rear end of the connector sleeve 60, the circuit board 3 can be inserted through the opening at the rear end of the microphone case 1. The circuit 3 board is not easily inserted through the concavo-convex part 61 compared with the other part. However, because the concavo-convex part 61 has not a large width, the circuit 3 board can be inserted up to the predetermined position by weak applied force.

Figure 5:
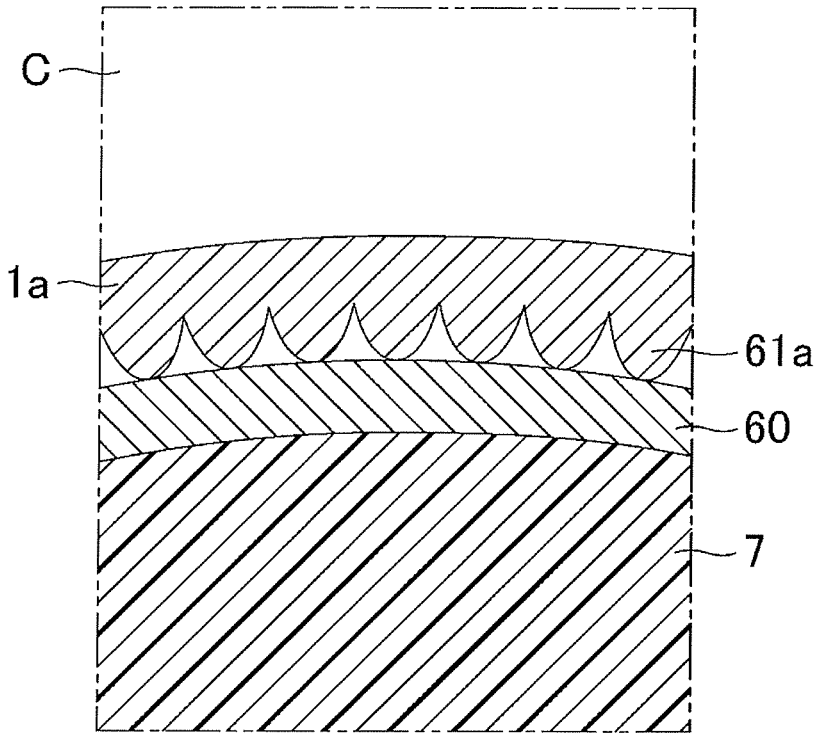
FIG. 5 is a partially enlarged view of another exemplary concave-convex surface according to an embodiment of the present invention.

Although the knurling processing is explained as an example process for forming concavo-convex part 61 in the illustrated embodiment, the present invention should not be limited to the embodiment. For example, as shown in FIG. 5, a concavo-convex part 61*a* is formed by broaching on the inner peripheral surface of the microphone case 1 such that the convex part of the concavo-convex part 61*a* is in contact with the outer peripheral surface of the connector sleeve 60. Thus, the same effect as the above-illustrated embodiment can be obtained.

In the condenser microphone according to the present invention, the concavo-convex surfaces formed on the fitting surface of the connector sleeve and the microphone case ensure a plurality of contact points uniformly on the entire peripheral surfaces thereof. Thus, an excellent electrostatic shield can be obtained to prevent electromagnetic waves from entering the inside of the microphone case, and prevent noise generation caused by the electromagnetic waves.

What is claimed is:

1. A condenser microphone, comprising:

a cylindrical microphone case having a condenser microphone unit therein;

a microphone connector having an insulating base insertable within the cylindrical microphone case with a gap therebetween, whereby one ground pin and two signal pins are embedded in the microphone connector; and a cylindrical connector sleeve having an electrically conductive concave-convex part on the outer peripheral surface thereof, wherein the cylindrical connector sleeve fills said gap between the microphone connector and the cylindrical microphone case, the concave-convex part on the outer peripheral surface of the cylindrical connector sleeve being in contact with the inner peripheral surface of the cylindrical microphone case at a plurality of points after the cylindrical connector sleeve is fixed into the end of the cylindrical microphone case by fixing means, and thereby the cylindrical connector sleeve is electrically connected with the cylindrical microphone case generating an electromagnetic shielding effect, and wherein the microphone connector is fixed by at least one screw to the cylindrical connector sleeve.

2. The condenser microphone according to claim 1, wherein the concave-convex part is adjacent to the rear end of the cylindrical connector sleeve.

3. The condenser microphone according to claim 1, wherein the concave-convex part is formed around the entire periphery of the cylindrical connector sleeve.

4. The condenser microphone according to claim 1, wherein the concave-convex part is formed by knurling.

5. A condenser microphone, comprising:

a cylindrical microphone case having a condenser microphone unit therein and an electrically conductive concave-convex part on the inner peripheral surface thereof;

a microphone connector having an insulating base insertable within the cylindrical microphone case with a gap therebetween, whereby one ground pin and two signal pins are embedded in the microphone connector; and a cylindrical connector sleeve which fills said gap between the microphone connector and the cylindrical microphone case, wherein the concave-convex part of the cylindrical microphone case is in contact with the outer peripheral surface of the cylindrical connector sleeve at a plurality of points after the cylindrical connector sleeve is fixed into the end of the cylindrical microphone case by fixing means, and thereby the cylindrical microphone case is electrically connected with the cylindrical connector sleeve, and wherein the microphone connector is fixed by at least one screw to the cylindrical connector sleeve.

6. The condenser microphone according to claim 5, wherein the concave-convex part is adjacent to the rear end of the cylindrical microphone case.

7. The condenser microphone according to claim 5, wherein the concave-convex part is formed by broaching.

8. The condenser microphone according to claim 1, wherein the concave-convex part is only adjacent to the rear end of the cylindrical connector sleeve.

9. The condenser microphone according to claim 5, wherein the concave-convex part is only adjacent to the rear end of the cylindrical microphone case.

* * * * *